United States Patent [19]

Jones et al.

[11] Patent Number: 5,066,457

[45] Date of Patent: Nov. 19, 1991

[54] RAPID SOLIDIFICATION ROUTE ALUMINIUM ALLOYS CONTAINING LITHIUM

[75] Inventors: Howard Jones, Sheffield; Panayiotis Tsakiropoulos, Petersfield, both of England; Charles R. Pratt, Neath, United Kingdom; Robert W. Gardiner, Farnham, England; James E. Restall, deceased, late of Camberley, England, by Janet E. Restall, executrix

[73] Assignee: The Secretary of the State for Defence in her Britannic Majesty's Government of United Kingdom, London, England

[21] Appl. No.: 346,173

[22] PCT Filed: Oct. 19, 1987

[86] PCT No.: PCT/GB87/00734

§ 371 Date: Apr. 13, 1989

§ 102(e) Date: Apr. 13, 1989

[87] PCT Pub. No.: WO88/03178

PCT Pub. Date: May 5, 1988

[30] Foreign Application Priority Data

Oct. 21, 1986 [GB] United Kingdom ..... 8625190

[51] Int. Cl.[5] ..... C22C 21/00; C22C 21/06

[52] U.S. Cl. ..... 420/552; 148/437; 148/438; 148/440

[58] Field of Search ..... 148/437, 438, 439, 440, 148/437, 438, 439, 440; 420/528, 552

[56] References Cited

U.S. PATENT DOCUMENTS 4,804,423 2/1989 Dubast ..... 148/437

*Primary Examiner*—Melvyn J. Andrews
*Assistant Examiner*—Robert R. Koehler
*Attorney, Agent, or Firm*—Nixon & Vanderhye, P.C.

[57] ABSTRACT

A rapid solidifcation rate (RSR) route aluminum alloy contains lithium and a dispersoid forming ingredient selected from niobium, molybdenum, hafnium, tantalum, and tungsten. These dispersoid forming ingredients resist coarsening in the matrix at solution treatment and ageing temperatures. The dispersoid forming ingredient is preferably present in 0.2 to 5.0 percent by weight.

5 Claims, No Drawings

RAPID SOLIDIFICATION ROUTE ALUMINIUM ALLOYS CONTAINING LITHIUM

This invention relates to aluminium based alloys containing lithium, made by the rapid solidification rate (RSR) route.

It is well known that lithium can be included in an aluminium alloy to reduce its density and increase its modulus of elasticity. Much work has been performed in this area on materials made by RSR routes as well as the more conventional wrought ingot route. RSR routes to the production of high modulus low density alloys based on aluminium-lithium offer at least the three following potential attractions:

(1) a more uniform and refined microstructure including elimination of ingot-derived coarse metallic second phases that can act as sites for crack initiation and corrosion:

(11) incorporation of dispersoid phases that are more effective in homogenising slip than are phases incorporated via the ingot route, so improving ductility and toughness; and;

(111) incorporation of higher lithium contents than can be accommodated by the wrought ingot route (by avoidance of segregation limitations) thereby offering the prospect of more significant reductions in density and increases in modulus and strength.

This invention concerns especially the dispersoid phase aspect of the RSR route aluminium-lithium art. Several dispersoid-forming additions have been investigated previously. One prior art investigation looked at the effects of 0.2 to 0.6 weight percent additions of manganese, chromium, iron, cobalt, titanium and zirconium on an aluminium—3 weight percent lithium alloy. Other additions which we know to have been investigated previously (in a variety of documents) are as follows (all proportions being by weight percent): 1 to 7 silicon; 0.2 titanium; 0.4 chromium; 0.2 to 3 manganese; 0.5 iron; 0.2–1 cobalt; 0.04 yttrium; and 0.2 to 1 zirconium.

The problem is one of developing a RSR route aluminium-lithium alloy having a good balance of those properties desirable especially for aerospace structural application, such desirable properties including; strength, high modulus, ductility and fracture toughness together with low density; and the present invention tackles this problem by providing new additives for such alloys, that resist coarsening in the aluminium-base matrix at elevated temperatures of the level that is likely to be experienced in solution treatment, in artificial ageing or in service.

The invention comprises an alloy formed by a rapid solidification rate process being based on aluminium and containing lithium together with X where X is one or more of the elements selected from a group of refractory metal elements consisting of niobium, molybdenum, hafnium, tantalum and tungsten.

Note that all compositions given hereinafter are expressed in proportions by weight.

X is preferably one of said elements rather than more than one, and X is preferably present in the alloy in proportion within the range 0.2 to 5.0 percent in order to achieve satisfactory effect without side effect or too great an increase in density.

Lithium is preferably present in the alloy in proportion within the range 1 to 5 percent. If lithium present in much greater proportion it would be likely to render the alloy overly brittle.

It has been found that the inclusion of such a refractory metal element in an aluminium-lithium base alloy confers improved strength to same (as reflected in the microhardness of RSR splats) and improved thermal stability (as reflected in the change of microhardness with exposure to temperatures representative of solution treatment temperature and artificial ageing temperatures). It is believed that these improved properties are consequent partly upon dispersoids formed within the aluminium matrix by the refractory metal element. It is expected that this benefit will not be significantly diminished by the presence in the base alloy of those ingredients other than lithium which have been added to aluminium-lithium alloys for strengthening purposes etc. A dispersion of the aluminium-refractory metal element compounds act to inhibit grain growth and thus help to retain the fine grain size inherent in RSR alloys. This fine grain size is important for the development of high strength and ductility. Solution heat treatment, quenching and ageing of the alloy results in the precipitation of aluminium-lithium based compounds as it would for dispersoid-free aluminium-lithium alloys. The presence of other elements such as copper, zinc and magnesium in an aluminium-lithium alloy which promote precipitation hardening in a solution treated alloy, is unlikely to markedly affect the grain growth inhibiting properties of the aluminium-refractory metal element dispersoid.

Various RSR methods well established in the art are suitable for the practice of the invention. RSR methods possess in common the imposition of a high cooling rate on an alloy from the liquid. RSR methods such as melt spraying, chill methods and weld methods are described in some depth in Rapid Solidification of Metals and Alloys by H Jones (published as Monograph No 8 by The Institution of Metallurgists) and in many other texts. The various RS routes differ from one another in their abilities in regard to control of cooling rate. The degree of dispersoid refinement and the extension of solid solubility are dependent on the rate of cooling from the melt.

Much of the laboratory work in connection with the current invention has been performed using a twin piston splat quenching method as described at pages 11 and 12 of the aforementioned text by H Jones. This technique is not susceptible to scale up to an industrial scale. For such larger scale use alternative well established RSR methods such as gas atomising or planar flow casting would be suitable.

The alloy may contain an ingredient or ingredients other than aluminium, lithium, and X such as those common in aluminium-lithium alloys, eg copper magnesium or zinc.

The alloy is exemplified by reference to the specific compositions given in Tables 1, 2 and 3 are for the alloys when produced as RSR splats within an argon atmosphere by the twin piston technique. The splats produced were typically around 50 mm thick and the cooling rate developed by the RSR process was of the order of $10^5$ to $10^6$ degrees Celcius per second. The recorded compositions shown in the first column of Tables 1 and 2 represent the measured composition of the source ingot. This will correspond closely to the composition of the splat at all times in the tests documented save in respect of the lithium content. The measured lithium content for most of the splats is given in parenthesis adjacent the relevent microhardness entry.

Table 1 below gives measurements of microhardness (expressed in kg/mm$^2$) as a function of time of exposure at 540 degrees Celcius this being a temperature representative of a solution treatment regime. The specimens were encapsulated prior to exposure within a quartz enclosure filled with argon. At completion of the exposure period the specimens were removed from the encapsulation and water-quenched to room temperature. Tantalum containing alloys are not documented in the quoted figures but are expected to have comparable properties.

TABLE 1

| Composition (of ingot) | As splatted | 1 hr | 10 hr | 100 hr | 1000 hr |
|---|---|---|---|---|---|
| Al—2.9Li—1.6Nb | 64 ± 3 (2.9) | 60 ± 6 (2.8) | 66 ± 6 (2.7) | 61 ± 6 (2.3) | 28 ± 6 (1.6) |
| Al—3.6Li—3.3Nb | 78 ± 2 (3.6) | 14 ± 4 (3.4) | 88 ± 17 (3.3) | 77 ± 16 (2.7) | 19.1 ± 1 (1.9) |
| Al—3.6Li—5.3Nb | 104 ± 1 (3.6) | 127 ± 1 (3.1) | 118 ± 10 (2.4) | 85 ± 6 (1.7) | 36 ± 5 (0.7) |
| Al—5Li—1.7Nb | 123 ± 5 | 143 ± 6 | 124 ± 4 | 119 ± 6 | 48 ± 8 |
| Al—3Li—0.6Mo | 105 ± 3 | 113 ± 5 | 106 ± 11 | 89 ± 6 | 34 ± 6 |
| Al—3.9Li—0.5Mo | 102 ± 9 (3.9) | 117 ± 6 (3.6) | 116 ± 7 (3.0) | 112 ± 8 (3.2) | 70 ± 1 (1.4) |
| Al—4.9Li—0—5Mo | 104 ± 8 (4.1) | 140 ± 25 (4.0) | 120 ± 8 (3.4) | 120 ± 5 (3.3) | 68 ± 5 (1.9) |
| Al—5Li—0.6Mo | 108 ± 1 | 124 ± 7 | 114 ± 5 | 91 ± 9 | 42 ± 13 |
| Al—2.8Li—5Hf | 109 ± 7 (2.8) | 146 ± 7 | 118 ± 6 | 88 ± 6 | 37 ± 7 |
| Al—3.5Li—4.2Hf | 129 ± 8 (3.5) | 148 ± 8 | 124 ± 5 | 104 ± 5 | 38 ± 7 |
| Al—2.5Li—1.1W | 103 ± 5 (2.5) | 122 ± 7 (2.6) | 76 ± 9 (2.5) | 52 ± 3 (1.9) | 25 ± 7 (1.2) |
| Al—2.9Li—1.8W | 76 ± 2 (2.9) | 102 ± 3 (2.8) | 78 ± 9 (1.2) | 67 ± 5 (0.8) | 25 ± 4 (1.5) |
| Al—3Li—2.8W | 118 ± 6 (3.0) | 129 ± 5 (3.0) | 162 ± 12 (2.9) | 88 ± 3 (2.3) | 44 ± 3 (0.6) |
| Al—3Li—1.5Zr* | 60 ± 4 (2.7) | 88 ± 3 (2.6) | 67 ± 6 (2.5) | 42 ± 7 (2.0) | 26 ± 5 (1.1) |
| Al—2.6Li* | 57 ± 1 (2.6) | 62 ± 4 (2.4) | 53 ± 6 (2.5) | 43 ± 4 (1.6) | 22 ± 4 (1.0) |

*Indicates a prior art alloy included for comparison purposes.

Table 2 below documents variations in microhardness and lithium content for a test similar to that in Table 1 save that it was conducted at a temperature of 160 degrees Celcius which is a temperature representative of artificial ageing conditions. Some of the specimens (those indicated) were subjected to a solution treatment of 1 hour at 540 degrees Celcius followed by water-quenching to room temperature prior to ageing. The remainder were subjected to the ageing treatment from the 'as-splatted' condition.

TABLE 2

| Composition (of ingot) | As splatted | 1 hr | 10 hr | 100 hr | 1000 hr |
|---|---|---|---|---|---|
| Al—3.6LI—3.3Nb | 80 ± 5 | 105 ± 10 | 117 ± 8 | 125 ± 5 | — |
| Al—3.6Li—5.3Nb | 103 ± 1 (3.6) | 146 ± 4 (2.8) | 153 ± 4 (2.9) | 172 ± 8 (2.8) | 127 ± 11 (2.7) |
| Al—5.0Li—1.7Nb | 123 ± 5 | 154 ± 2 | 169 ± 8 | 179 ± 4 | 130 ± 9 |
| Al—3Li—0.6Mo | 105 ± 3 | 150 ± 3 | 158 ± 4 | 165 ± 4 | 103 ± 8 |
| Al—3.9Li—0.5Mo | 102 ± 9 (3.9) | 112 ± 10 (3.5) | 133 ± 6 (3.2) | 134 ± 7 (2.3) | — |
| Al—3.9Li—0.5Mo | 102 ± 9 (3.9) | 133 ± 5 (3.2) | 129 ± 12 (2.9) | 134 ± 7 (2.6) | — |
| Al—4.1Li—0.5Mo | 104 ± 8 (4.1) | 130 ± 12 (3.6) | 148 ± 15 (3.1) | 190 ± 22 (2.5) | |
| Al—4.1Li—0.5Mo | 104 ± 9 (3.9) | 125 ± 11 (3.4) | 140 ± 15 (3.0) | 156 ± 11 (2.3) | |
| Al—5Li—0.6Mo | 109 ± 10 | 159 ± 8 | 162 ± 5 | 171 ± 6 | 114 ± 2 |
| Al—2.8Li—5.0Hf | 108 ± 7 | 148 ± 4 | 159 ± 6 | 164 ± 5 | 129 ± 10 |
| Al—3.5Li—4.2Hf | 129 ± 8 | 153 ± 10 | 178 ± 7 | 185 ± 7 | 133 ± 10 |
| Al—2.9Li—1.8W | 72 ± 4 (2.9) | 116 ± 6 | 119 ± 9 | 120 ± 8 | — |
| Al—3Li—2.8W | 117 ± 6 (2.8) | 144 ± 9 (2.8) | 163 ± 2 (2.8) | 165 ± 3 (2.5) | 131 ± 7 (2.8) |
| Al—3Li—1.5Zr | 62 ± 5 | 90 ± 5 | 99 ± 6 | 104 ± 5 | — |
| Al—2.6Li* | 60 ± 3 (2.6) | 94 ± 3 (2.5) | 108 ± 8 (2.5) | 116 ± 7 (2.5) | — |
| Al—2.6Li* | 60 ± 3 (2.6) | 86 ± 11 (2.1) | 105 ± 9 (2.3) | 107 ± 12 (2.1) | |

*Indicates a prior art alloy included for comparison purposes.

It is recognized that the experimental results presented above document the properties of the claimed alloy only by reference to microhardness measurements of splat speciments. It is expected that these figures will to a large extend be a valid indication of the strength and stability properties of the claimed alloy when produced on an industrial scale under suitable RSR condition.

Table 3 below documents one comparative test of an alloy of the invention against a reference alloy. The aluminium—4 lithium—0.6 molybdenum alloy was produced as RSR powder by inert gas atomising. The powder was canned and then extruded (without the usual intermediate degassing treatment) to round bar at a 25:1 reduction ratio. The extruded bar was solution treated at 540 degrees Celcius for one hour, water quenched, then aged for one hour at 160 degrees Celcius. The comparitive data relates to a comparable prior art alloy and the figures given are taken from a published work—a paper by P J Meschter et al at page 85 et seq of Aluminium-Lithium III (the proceedings of the Third International Aluminium-Lithium Conference) published by The Institute of Metals. The data given is for an alloy of aluminium—4 lithium—0.2 zirconium extruded from RSR powder, solution treated at 588 degrees Celcius then aged for one hour at 160 degrees Celcius.

TABLE 3

| Composition | 0.2% Proof Stress | Tensile Stress | Elongation |
|---|---|---|---|
| Al—4Li—0.6Mo | 472 MPa | 519 MPa | 1% |
| Al—4Li—0.2Zr | 390 MPa | 475 MPa | 10% |

The above quoted alloy of the invention is unlikely to be representative of the true merits of the invention for the figures document a process not optimised with regard to the RSR powder production and without the important degassing stage. However the quoted alloy, even in this condition, shows a useful increase in strength over the reference alloy. It should be recognised that although this comparison is fair with regard to the equivalence of the materials documented it does not document the best of prior art materials nor is it likely to document the best materials of the invention.

As mentioned previously the alloy of the invention is not limited to an aluminium—lithium—X system for it is possible that additions other than lithium and X will be incorporated within the aluminium base in order to yield a material having a better blend of properties than can be secured through a ternary alloy. It is postulated that the alloy could include up to 5 percent or thereabouts of one or more ingredients selected from the group consisting of copper zinc manganese and magnesium.

We claim:

1. An alloy formed by a rapid solidification rate process consisting essentially of the following ingredients in proportions by weight:

*Li* 1-5% one or more of the following refractory elements within the individual proportions stated below and in total proportion not exceeding 5% when present in combination:

Nb 0.2-5.3%
Mo 0.2-5.0%
Hf 0.2-5.0%
Ta 0.2-5.0%
W more than 0.3-5.0with Al as balance, save for incidental impurities and save for up to 5% in total of one or more of the following conventional strengthening ingredients within the individual proportions stated:
Cu 0-5%
Mg 0-5%
Zn 0-5%.

2. An alloy as claimed in claim 1, consisting essentially of 1-5% of lithium and 1-5% of niobium, in proportions by weight.

3. An alloy as claimed in claim 1, consisting essentially of 1-5% of lithium and 0.5-1.5% of molybdenum, in proportions by weight.

4. An alloy as claimed in claim 1, consisting essentially of 1-5% of lithium and 3-5% hafnium, in proportions by weight.

5. An alloy as claimed in claim 1, consisting essentially of 1-5% of lithium and 1-3% tungsten, in proportions by weight.

* * * * *